United States Patent [19]

Kelly

[11] 4,044,780

[45] Aug. 30, 1977

[54] APPARATUS FOR TOTAL BLEND EXPANSION

[75] Inventor: James G. Kelly, Richmond, Va.

[73] Assignee: American Brands, Inc., New York, N.Y.

[21] Appl. No.: 610,740

[22] Filed: Sept. 5, 1975

[51] Int. Cl.[2] ..... A24B 3/18

[52] U.S. Cl. ..... 131/135; 131/136; 131/140 P

[58] Field of Search ..... 131/140 P, 121, 134; 34/10, 57

[56] References Cited

U.S. PATENT DOCUMENTS

| | | | |
|---|---|---|---|
| 544,969 | 8/1895 | Dodge | 302/31 |
| 545,013 | 8/1895 | Dodge | 138/103 |
| 2,236,006 | 3/1941 | Mulvany | 34/24 |
| 2,344,106 | 3/1944 | Reed | 131/136 |
| 2,501,487 | 3/1950 | Whitman | 34/57 |
| 2,513,369 | 7/1950 | Shaw | 34/10 |
| 2,596,183 | 5/1952 | Sowa | 131/140 |
| 2,739,599 | 3/1956 | Abbott, Jr. | 131/121 |
| 3,131,974 | 5/1964 | Futer | 302/31 |
| 3,137,546 | 6/1964 | Lamb | 34/10 |
| 3,144,871 | 8/1964 | De Souza et al. | 131/140 |
| 3,180,688 | 4/1965 | Futer | 302/29 |
| 3,210,130 | 10/1965 | Kelly | 302/36 |
| 3,222,110 | 12/1965 | Kelly et al. | 302/2 |
| 3,304,619 | 2/1967 | Futer | 34/10 |
| 3,357,436 | 12/1967 | Wright | 131/135 |
| 3,394,463 | 7/1968 | Futer | 34/10 |
| 3,409,022 | 11/1968 | de la Burde | 131/140 P X |
| 3,409,023 | 11/1968 | de la Burde | 131/140 P X |
| 3,435,536 | 4/1969 | Tinley | 34/57 |
| 3,529,606 | 9/1970 | de la Burde | 131/140 |
| 3,558,111 | 1/1971 | Avery | 263/21 |
| 3,575,178 | 4/1971 | Stewart | 131/140 |
| 3,612,066 | 10/1971 | Jones et al. | 131/143 |
| 3,734,104 | 5/1973 | Buchanan | 131/140 P |
| 3,799,176 | 3/1974 | Wochnowski | 131/135 |
| 3,821,342 | 6/1974 | Hurd | 264/53 |
| 3,957,063 | 5/1976 | Wochnowski | 131/140 P |

*Primary Examiner*—Robert W. Michell
*Assistant Examiner*—V. Millin
*Attorney, Agent, or Firm*—Pennie & Edmonds

[57] ABSTRACT

Apparatus for increasing the filling capacity of a total blend of cut tobacco comprising first unit for elevating the temperature and moisture content of the tobacco such that the heating and moisturizing are performed for a time sufficient to permit cut tobacco to open from its crimped and compressed condition, an assembly for forming a relatively thin dispersion of the opened tobacco in a gas, and an apparatus operatively connected to said first unit for rapidly lowering the moisture content of the thin dispersion of tobacco to about its making moisture within about five seconds such that the tobacco has achieved an expanded and opened condition.

20 Claims, 4 Drawing Figures

APPARATUS FOR TOTAL BLEND EXPANSION

BACKGROUND OF THE INVENTION

This particular invention generally relates to the expansion of tobacco for purposes of increasing its filling capacity. Specifically, it pertains to a novel and improved apparatus which rapidly, economically, simply, and reliably expands a total blend of tobacco to the extent that the entire blend may be used in the fabrication of complete rod-like tobacco products, such that the expanded tobacco resists the tendency to close back, possesses the structural characteristic of non-collapsibility, and does not contain materials unnatural to tobacco.

Presently, in the tobacco industry various techniques exist for puffing tobacco so as to obtain a greater filling capacity therefor. What essentially occurs in a typical puffing operation is that the normally compressed and dried tobacco is dimensionally expanded to a certain extent such that it is somewhat restored to the dimension it had prior to the standard drying and cutting procedures.

Generally speaking, a major disadvantage associated with heretofore known puffing techniques is the degree of expansion which frequently results. In particular, the foregoing type of expansion is of such a relatively large magnitude that in the event an entire blend or batch of shredded and/or artificially treated tobacco is exposed to such conventional processes and subsequently utilized to form the standard types of rod-like tobacco end products, such as cigarettes or the like, it suffers from the shortcoming that the tobacco end product is relatively easily collapsible. Such collapsibility will correspondingly result in end products which lack firmness and are otherwise of lower quality. Quite obviously, such tobacco end products as cigarettes and the like made exclusively of this expanded tobacco would tend to be undesirable for typical purposes of commercially marketing the same.

Accordingly, to obviate the previously mentioned disadvantages, it has become a rather customary and accepted industry practice to admix only a partial amount of the expanded tobacco with the usual non-expanded tobacco. The resulting admixture results in a compromise which provides rod-like tobacco products at least partially formed from puffed tobacco which has sufficient structural rigidity in customary usage. However, such processes nonetheless fail to completely and satisfactorily enable a total blend of tobacco to be used exclusively in forming firm and commercially acceptable tobacco end products. Moreover, by reason of the fact that expanded and non-expanded tobacco must be admixed, additional drawbacks result. For instance, an extra blending step is required, as well as the requirement for separate storage facilities to conveniently store the expanded and non-expanded tobacco. The additional blending step and separate storage facilities, of course, result in increased costs.

Apart from the foregoing commented upon shortcomings in known prior art expansion processes, some of such processes typically rely upon undesirable artificial chemical solvents to achieve puffing. The use of artificial chemical solvents normally results in a tendency to leave non-tobacco elements with the tobacco. Moreover, aside from the aforementioned disadvantages, undesirable artificial chemical solvents add to the overall cost factors in producing tobacco end products.

In connection with the traditional drying apparatus used in the field for drying tobacco, many require considerable periods of time to effectuate an adequate drying operation. Therefore, they result in additional operational time and costs which further detract from any economic savings which might otherwise be possible with quicker drying modes of operation. Furthermore, there is tendency for mechanical abuse to occur to the tobacco in these known tobacco dryers. Mechanical abuse contributes to the break-up of tobacco which correspondingly results in a less satisfactory final product.

In view of the foregoing comments directed to the various known prior art forms of apparatus and methods for purposes of increasing the filling capacity of tobacco, it will be appreciated that the prior art cannot achieve, in a simple, reliable, rapid and economical manner, the expansion of tobacco materials, and particularly a total blend of tobacco, such that the expanded tobacco can be exclusively employed for the fabrication of conventional rod-like tobacco products which have the firmness necessary for ordinary use. In addition, such conventional techniques are relatively expensive since they utilize non-expanded tobacco to obtain a suitable structurally rigid rod-like product and sometimes rely upon non-tobacco elements.

SUMMARY OF THE INVENTION

The present invention overcomes the previously mentioned disadvantages of the conventional prior art devices for achieving expansion of tobacco by providing a novel and improved apparatus in which tobacco materials, including a total blend of tobacco, have their filling capacity increased to the extent that a complete blend of expanded tobacco may be utilized to successfully form cigarettes and the like wherein such cigarettes are firm and of high quality. In addition, it is further contemplated by the present invention to satisfactorily achieve the foregoing in an economical, rapid, and reliable manner without unnatural artificial chemical solvents and by minimizing mechanical abuse of the tobacco in a drying process.

Briefly, the present invention comprises an apparatus for increasing the filling capacity of cut tobacco material, preferably a total blend, comprising first means for elevating the temperature and moisture content of the tobacco, such that the heating and moisturizing are performed for a time sufficient to permit the cut tobacco to open from its crimped and compressed condition, means for forming a relatively thin dispersion of the opened tobacco in a gas, and means operatively connected to said first means for rapidly lowering the moisture content of the thin dispersion of tobacco to about its making moisture within about 5 seconds such that the tobacco has achieved an expanded and opened condition.

BRIEF DESCRIPTION OF THE DRAWINGS

The above, as well as other objects, features and advantages of the present invention will become readily apparent after a reading of a detailed description of the preferred embodiment when viewed in conjunction with the accompanying drawings wherein like reference numerals indicate like structure through the several views.

DETAILED DESCRIPTION

Figure 1:
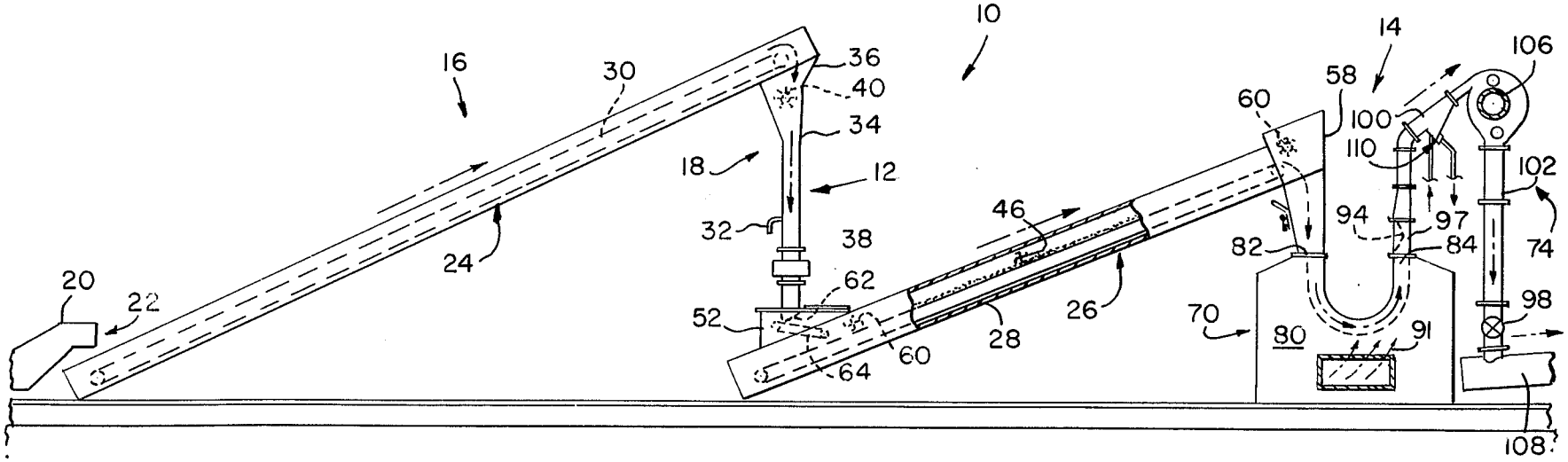
FIG. 1 is a schematic side elevational view illustrating the apparatus embodying the principles of the present invention.

Referring to the drawings, there is depicted a novel and improved apparatus embodying the principles of the present invention being generally designated by reference numeral 10. Apparatus 10 is adapted for use in increasing the filling capacity or power of tobacco T including leaves and/or stems, and/or veins so that an entire amount of tobacco material may be subsequently employed for the complete formation of tobacco end products. More particularly, the apparatus 10 is particularly adapted to increase the filling capacity of a blend of different tobaccos and tobacco materials used to make cigarettes, cigars, or other tobacco products formed from shredded tobacco and tobacco materials. This blend of tobaccos is hereinafter referred to as the "total blend".

It will be recognized that a variety of different types and proportions of tobacco (Burley, Bright, etc.) and tobacco materials (leaf, stem, veins, etc.) can be and are used in forming the total blend dependent upon the flavor and other characteristics desired in the end product. The instant invention is suitable for all such varieties and the types of tobacco and tobacco materials used and the proportions used. The total blends can be formed by any conventional procedure, as by admixing the various components and shredding them in a cutter, such as a standard Molins or Legg cutter (not shown).

Although the subsequent description of the particular use of apparatus 10 is directed to expanding or puffing tobacco and tobacco materials T, it will be appreciated that it is within the spirit and scope of the instant invention that apparatus 10 may be used to expand other types of materials, in which it is desired to improve the filling capacity for various commercial and industrial purposes.

Essentially, hereinafter described, the apparatus 10 as envisioned by the present invention, includes, in combination, first or conditioning means 12 for at least selectively elevating the temperature and moisture content of the tobacco T immediately prior to expansion or puffing, and second or expanding means 14 operatively connected to the conditioning means 12 for at least rapidly expanding and drying a fine stream or thin dispersion of conditioned tobacco T such that the tobacco T is expanded and opened from a crimped, twisted position and is able to resist the normal tendency to close back.

The conditioning means 12 basically includes conveying means 16 and treating means 18. It will be understood that the tobacco T before being associated with conveying means 16 has been shredded and otherwise treated in accordance with conventional procedures. In addition, the shredding or cutting techniques employed in the tobacco industry cause the tobacco to become somewhat compressed and laminated together.

The conveying means 16 may include a conventional spreader-feeder 20 first conveying mechanism 24 and second conveying mechanism 26. First and second conveying mechanisms 24 and 26, respectively, are basically constructed of conventional commercially available components and are driven by well-known types of drive systems. Therefore, a detailed description as to their construction and operation will not be given, since it does not form an aspect of this invention. It will also be recognized that suitable structural supports (not shown) are employed to support the conveying mechanisms in their depicted positions.

With reference to spreader-feeder 20, it is of a conventional type presently available and of well-known construction. Essentially, its discharge end 22 positioned above first conveying mechanism 24 so as to deliver a controlled amount of shredded tobacco T onto the belt 30 of first conveying mechanism 24. It will be appreciated that the discharge rate of spreader-feeder 20 and speed of conveyor belt 30 of first conveying mechanism 24 are appropriately adjusted so that a constant layer of tobacco T is provided.

Treating means 12, as best illustrated in FIG. 1, is seen to essentially include heating, ordering, and metering chute 34. The ordering chute 34 includes a hopper-type structure 36 and a steaming jacket 38. The hopper 36 is suitably fastened to the discharge end of the first conveying mechanism 24 and forms a funneled inlet to the ordering chute 34. Treating means 18 may also include a standard type of motor driven doffer 40 which is appropriately connected to and supported by the hopper 36. In addition, level control means 32 are provided to control the height of the tobacco in chute 34 for proper conditioning. Control means 32 can be an electric eye, infra-red, sonic beam, fluidic means, or other conventional control means. Control means 32 acts to control the speed (not shown) of conveyor 56 (hereinafter described) thereby regulating the height of the tobacco in chute.

Basically, the heating, ordering, and metering chute 34 serves to elevate the temperature and moisture content and water vapor pressure of the shredded tobacco materials T for purposes afterwards described.

Greater detail as to what occurs during the course of this conditioning process is described in copending application Ser. No. 610,736 filed on even date herewith. However, it will be understood that the elevated temperatures and moisture conditions are for a duration which enable the cut and generally crimped tobacco T to open from the compressed form. It should be pointed out that whenever the shredded tobacco T is in its more opened condition, it has a more irregularly shaped form as opposed to the compressed form. As previously observed, such compressed conditions result from the normal processing and cutting or shredding operations.

Figure 2:
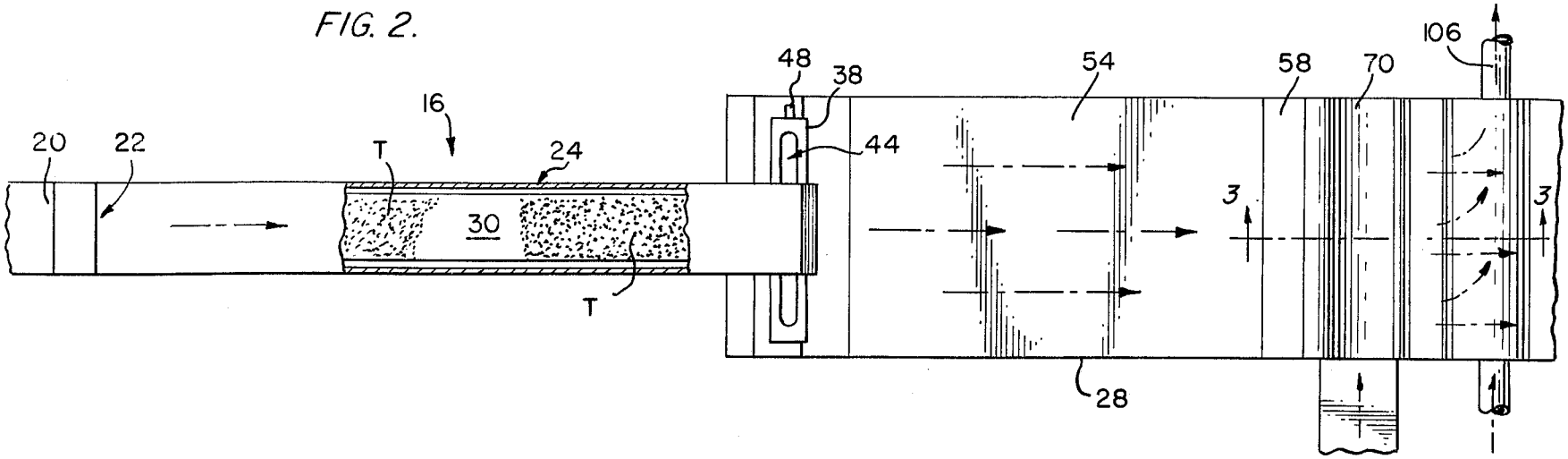
FIG. 2 is a plan view illustrating the apparatus shown in FIG. 1.

As best shown in FIG. 2, chute 34 defines a generally vertically positioned opening 44 for permitting the passage therethrough of the shredded tobacco. In this embodiment, the opening 44 is generally oval in shape for facilitating improved movement of tobacco T. Chute 34 includes a hollow steaming jacket 38 which surrounds the opening 44. The jacket 38 receives steam through inlet 48. Jacket 38 distributes the steam into opening 44 through a plurality of vent openings (not shown) formed in the jacket 38. Such an arrangement enables the intermixing of steam with the shredded tobacco T. In addition, the chute 34 further functions in a similar manner as a conventional metering chute for purposes of controlling the discharge of treated or conditioned tobacco therefrom. The tobacco T which descends into the opening tends to accumulate therein. As described, the amount of tobacco T discharged from the ordering chute 34 may be adjusted by varying the speed of conveyor 56. Such chute 34, as contemplated by the present invention may also utilize any well-known types of devices for detecting temperature and moisture content, also not shown, for purposes of further providing for a more uniform and precise temperature and moisture level of the tobacco during conditioning.

In treating or conditioning the shredded tobacco, sufficient steam should be introduced into the jacket 38 to heat the tobacco T to at least a temperature of about 130° F. Additionally, it is contemplated that such steam be applied so as to enable the moisture content of the tobacco to increase to about between 15 and 35%. Moreover, although the temperature of the tobacco can rise to above 130° F., its maximum should be below that at which the tobacco T will become scorched or discolored and preferably not above 250° F. By way of illustration and not limitation, a temperature of about 190° F. has been found to provide improved end results. As will be subsequently explained, by heating the tobacco to a temperature which approaches the boiling point of the water therein, an improved expansion occurs. It has been determined that the time necessary to condition the tobacco T can vary from a period of seconds to about 5 minutes.

The particular time and conditions will also vary dependent upon the type of tobacco and its previous history, such as the pressure during cutting or shredding. The most optimum conditions can be readily determined by exposing a particular total blend to heat and moisture treatment within the ranges noted and then observing the temperature and moisture levels which are most effective in giving the desired increase in filling capacity. Although the preferred embodiment discloses that a chute 34 is employed, it will be understood that conditioning of the tobacco T can be carried out in any suitable apparatus, whether horizontal or vertical, into which the tobacco can be fed, preferably continuously, and in which the temperature and moisture content can be controlled.

After the tobacco T has been conditioned in the manner indicated above, it will migrate downwardly from the bottom of ordering chute 34 and fall onto the second conveying mechanism 26.

In regard to the second conveying mechanism 26, continued reference is made to FIGS. 1 and 2. Basically, conveying mechanism 26 is arranged such that its endless conveying belt 30 advances tobacco T from chute 34 toward expanding means 14, as indicated by the arrows in FIGS. 1 and 2. As depicted, conveying mechanism 26 has associated therewith, support section 52, covering means 54, discharge conveying device 56, discharge housing 58 and a standard doffer mechanism 60. In addition, kicker 46 is provided to provide a substantially uniform layer of conditioned tobacco to the inlet section of the drying means where doffer 60 acts to disperse it into the dryer.

The support section 52 is suitably connected to the discharge end of the chute 34. Disposed beneath the discharge end 62 of the oval chute opening 44 and housed within the support section 52 is discharge conveying device 56 and doffer 60. In this particular embodiment, such device 56 includes a declined conveying belt 64 which functions to provide for a more uniform delivery of the discharged and treated tobacco T onto belt 30 of conveying mechanism 26. This in conjunction with doffer 60 and kicker 46 contributes to the achievement of a relatively uniform layer of tobacco T which is advanced to the expanding means 14. Towards this particular end, conveying device 56 is positioned so that it slopes downwardly from the discharge end 62 of ordering chute 38 to the belt 30 of the conveying mechanism 26. It will be recognized that the rates of movement of the declined belt 64, conveying belt 30 of conveying mechanism 26, as well as the discharge rate from ordering chute 34 are appropriately adjusted so that a relatively uniform layer of tobacco T is carried to the dryer.

As previously described, the present invention embodies covering means 54. Such covering means 54 essentially serves the purpose of preventing undesired amounts of heat to dissipate from the conditioned tobacco T as it travels from the ordering chute 34 to the expanding means 14. Towards this particular end, any suitable type of material may be used which will tend to diminish excessive heat flow from the tobacco T during transport. Whatever structure is used, however, it should be appropriately connected to the conveying mechanism 26 so that the open top portion thereof is effectively enclosed. As will become evident by retaining the heat, the tobacco T will be better able to expand in expanding means 14. Although covering means 54 has been described for use in conjunction with conveying mechanism 26, it will be appreciated, of course, that such need not be provided. In fact, conveying mens 26 is not essential and the prior conveyors and chute 34 can be positioned so as to feed the conditioned tobacco directly from the chute 34 into expanding means 14 if desired with appropriate dispersion effected by means of doffers or the like.

Connected to the discharge end of the second conveying mechanism 26 is discharge housing 58. Discharge housing 58 serves to suitably interconnect the end of the second conveyor 26 to the expanding means 14 for enabling the treated tobacco T to enter the latter. Doffer mechanism 60 is of a well-known type and is suitably connected to the discharge housing 58 such that it is disposed within the interior thereof adjacent the end of belt 30. The doffer mechanism 60 is driven at a high rate of speed relative to the speed of movement of the belt 30 of conveying mechanism 26. By reason of this arrangement, the tobacco T is able to be picked or pulled off more easily from belt 30. Furthermore, the doffer not only serves to prevent hang-up of the tobacco T but also provides for a uniform acceleration of tobacco T into expanding means 14.

Figure 3:
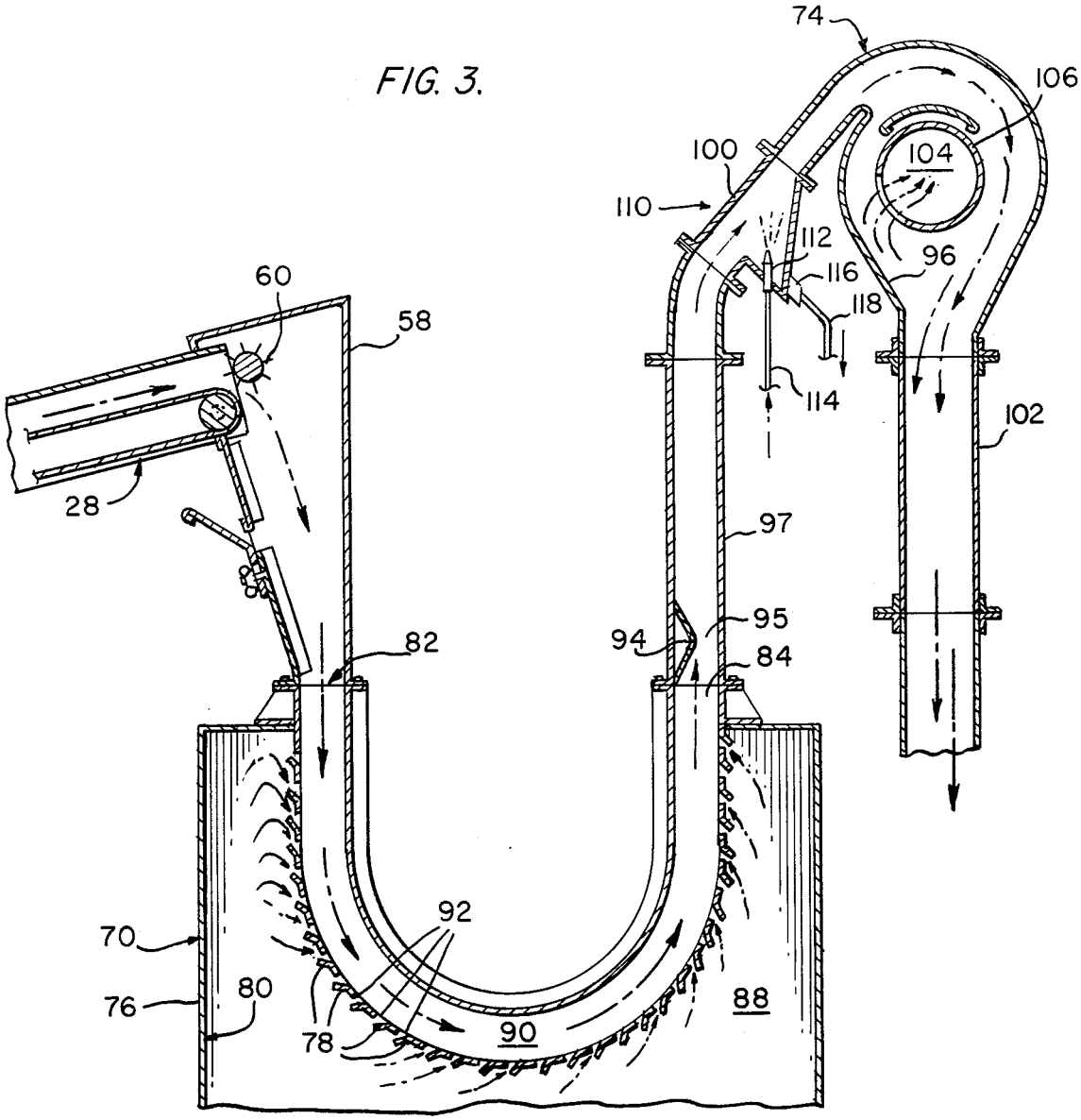
FIG. 3 is an enlarged side elevational view taken substantially along section line 3—3 appearing in FIG. 2 and illustrating the drying apparatus of the present invention.

Turning now to tobacco expanding means 14, reference is made to FIGS. 1 and 3. As shown, tobacco expanding means 14 includes drying means 70 and separating means 74.

In connection with the drying means, 70, it essentially functions to flash dry the tobacco T in an extremely rapid manner for purposes afterwards explained. Basically, drying means 70 is comprised of a dryer housing member 76 and perforated screen 78. Dryer housing member 76 includes walls 80 that define a generally hollow interior, as well as respective inlet and outlet openings 82 and 84. Additionally, a hot-gas inlet 86 is suitably formed in a side wall 80 of the housing member 76 for purposes afterwards described. Perforated screen 78 is connected between the inlet and outlet openings 82 and 84, respectively, to form a plenum chamber 88 and a tobacco passageway 90. The hot gas inlet opening 86 communicates with the plenum chamber 88 and enables the introduction therethrough of a hot gas medium indicated by reference 91, which is supplied from a conventional suitable source (not shown). The hot gas medium 91, as contemplated for use in the present embodiment may be standard hot, moist air. With hot, moist air it will be appreciated that the water vapor pressure thereof will be relatively low, especially in comparison to the water vapor pressure of the moisture in the treated tobacco T. Normally, for optimum results, the hot gas temperature should range from about 300° F to 600° F. Such values are given for purposes of illustration and not limitation.

As previously indicated, perforated screen 78 divides the dryer housing member 76 into a plenum chamber 88 and a tobacco passageway 90. The tobacco passageway 90 is designed to accommodate the relatively fine dispersion D of tobacco T in the gas. Such passageway 90 is appropriately sized and the velocity of the gas regulated so as to prevent passageway 90 from being choked or otherwise becoming clogged by the tobacco. Perforated screen 78 has a generally U-shaped configuration which correspondingly forms a generally U-shaped tobacco passageway 90. The generally U-shaped configuration has been determined to be a space saving arrangement. Accordingly, such facilitates a more efficient utilization of plant floor space. Of course, it will be appreciated that perforated screen 78 may be configured to define other suitably shaped passageways.

A plurality of louvers or slots 92 are formed in perforated screen 78 and are arranged in an appropriate pattern throughout the entire extent thereof. Basically, the slots 92 act to direct corresponding streams of hot gas into the tobacco passageway 90 for rapidly transporting the thin laminar dispersion D of tobacco T through the dryer. The slots 92 are, preferably, arranged in corresponding parallel rows (not shown) wherein adjacent rows have the slots 92 staggered with respect to the opposite rows. Through this particular arrangement of slots 92, turbulence within passageway 90 will be minimized as the thin laminar flow of tobacco T passes therethrough. Of course, other appropriate arrangements and patterns of slots 92 may also be used within the spirit and scope of the invention so long as they tend to decrease turbulence. Consequently, the shredded tobacco T can, in a more efficient manner, uniformly and quickly pass through the dryer housing member 76.

The conveyance velocity in which the hot gas 91 travels through the slots 92 should be at least sufficient in magnitude to create a pressure drop adjacent such slots 92 in tobacco passageway 90 so as to facilitate the uniform advancement of the hot gas 91 as well as tobacco T through such passageway. It will be recognized, of course, that the minimum conveyance velocity will be selected in accordance with sound engineering principles as to achieve the desired end of conveying the hot-gas 91 and tobacco T through passageway 90. Preferably, such conveying velocity should be of such a magnitude that it will enable the thin tobacco dispersion to be passed through the tobacco passageway in about less than 2 seconds. Although the present embodiment prefers that the tobacco T be conveyed through the dryer housing member 76 in about less than about two seconds, it has been also discovered that suitably drying and expanding of tobacco T may result if the tobacco is conveyed through the dryer in a time up to about 5 seconds.

In the tobacco passageway 90, it will be appreciated that the moisture content of the tobacco T is lowered to approach its normal making moisture content. For most tobacco blends used in forming cigarettes, such moisture level is about 11 to 16%. During this loss of moisture content, the filling capacity of the tobacco T has been increased.

It is important from the standpoint of achievement of this reduction in moisture content and corresponding increase in filling capacity that the dispersion of tobacco T be relatively thin. In this particular manner, there is a greater intimacy or optimization of contact of the tobacco surfaces with the dry, hot air 91.

While the precise theory for this controlled increase in filling capacity is not completely understood, it is believed that, during the conditioning, some delamination and opening of the shredded tobacco occurs. The elevation, moreover, of tobacco temperature to near the boiling point of water permits the water to be rapidly removed when the tobacco enters the drying step. This high temperature treatment coupled with short treatment time is such to cause the water vapor not only to assert an evaporative cooling action, but the rapid water removal causes the water vapor leaving the tobacco structure to assert a positive internal pressure such that the expansive effect is greater during drying than for processes usually associated with conventional tobacco drying. Such action is facilitated by the intimacy of contact between the tobacco and dry air.

Thus, the resultant final dried tobacco shreds have been expanded and opened from compressed positions and are stabilized in that state, resisting the closing back thereof which would occur during cigarette manufacture. Of importance is the fact that this treated tobacco retains its increase in filling capacity which can vary from about 5% to 25% greater than conventionally dried tobacco even during the handling required in cigarette manufacture.

Moreover, since the tobacco T enters the drying member 76 in thin dispersions D and travels quickly therethrough, there is a diminished tendency for the tobacco to experience mechanical abuse.

Although the most desirable condition would be to have a constant flow rate of tobacco it should be pointed out that this dryer is more adaptable to varying flow rates than conventional drying equipment. Takeaway conveyor 56 is modulated in speed either in step fashion or proportionally to accommodate the varying input rate and the wet bulb of the drying air modulated by proportional water conditioning such that the drying effect is the same for varying rates. In other words, the inherent disadvantages of the first lot of tobacco into a dryer and the last to come out, as well as the normal interruptions in flow, can be instantly compensated for.

More effective drying is obtained if means are provided for creating turbulence of the gas stream and rapid acceleration of the gas relative to the tobacco surfaces immediately after they exit from the dryer 76. As depicted in FIGS. 1 and 3, accelerating means 94 is defined by an air-tight venturi member which has a generally triangular shape in cross-section. Of course, other types of configurations are conceivable and usable. Venturi member 94 is positioned within an outlet duct 97 for the drying member 76 so that a relatively narrow space 95 exists between its apex and the inner wall of duct 97. For example, if the duct 97 has a width of about 6 inches, a venturi member which defines a 2-inch space 95 between it and the duct 97 will achieve the desired acceleration required. The foregoing dimensions were given for purposes of illustration and should not be considered limiting in any respect. It will also be understood that other means for increasing the acceleration or velocity, such as an orifice or a contraction in the exit duct, can be used in place of the venturi.

Essentially, the venturi member 94 significantly accelerates the hot air 91 so that it increases or boosts velocity of such hot gas stream relative to the thin tobacco stream D. It is believed that such a rapid increase in velocity creates a turbulence whereby the hot gas 91 tends to wipe moisture from the surfaces of the shredded tobacco T. It is believed such moisture has formed on the surface of the tobacco T as a result of the rapid vaporizing which occurs through the intimate contact of the hot air 91 and of tobacco T in the tobacco passageway 90. Since such intimacy of contact remains between the heated air 91 and thin dispersion D of tobacco T, this wiping action will better be able to remove such moisture. By wiping the tobacco surface, it is believed that the removal of moisture and puffing of tobacco T are able to be more satisfactorily completed. It should be recognized that the foregoing explanation is theoretical and represents what the inventors at present believe occurs. However, it is known that by having the venturi member 94 positioned in the manner indicated, the significant expansion of applicants' invention is achieved.

In connection with the separating means 74, it is best depicted in FIGS. 1 to 3. As illustrated, separating means 74 includes a standard type of centrifugal device 96 and an appropriate separating air lock means 98. Inlet and outlet ducts 100 and 102 are connected to the centrifugal separating device 96. Centrifugal separating device 96 is constructed of conventional commercially available components and, therefore, a detailed description of its construction is not deemed necessary since it does not form an aspect of the invention. To basically understand the operation thereof, however, it will be understood that, as the admixture of expanded or puffed tobacco T and hot drying air 91 exit past the venturi member 94 and enter inlet duct 100. Inlet duct 100 directs the thin stream D of puffed or expanded tobacco T and hot gas 91 to the separating device 96. In a well-known fashion, the hot air 91 and tobacco T are separated in such a manner that the tobacco T, under the influence of gravity, descends outlet duct 102 while the air exits through opening 106. The heated air 91 which is directed outwardly from the centrifugal separating device 96 through opening 106 may be appropriately recycled in whole or in part for repeated use as the drying air 91 in the flash dryer device 76. Air lock means 98 may be defined by a standard rotary air lock device which essentially functions to discharge amounts of the expanded tobacco T onto an output conveyor 108. Conveyor 108 will advance the expanded tobacco T to an appropriate station for further processing such as cooling and flavoring.

In view of the foregoing description, the operation of apparatus 10 is believed evident. To supplement such description, however, it will be understood that the tobacco T, in shredded form, is conveyed by the first conveying mechanism 24 to the treating means 18. Treating means 18 elevates the temperature of the tobacco T to above about 130° F., and elevates the moisture content of such tobacco to above bout 15%. The heating and moisturizing operations are performed for a time sufficient to permit cut tobacco T to open from its compressed condition. After discharge from treating means 18, the tobacco T drops onto the conveying mechanism 26. Expanding means 14 is operatively connected to said treating means 18 for rapidly lowering the moisture content of the thin dispersions D of tobacco T to about its making moisture within about 5 seconds such that the tobacco has achieved an expanded and opened condition which resists the closing back thereof.

Figure 4:
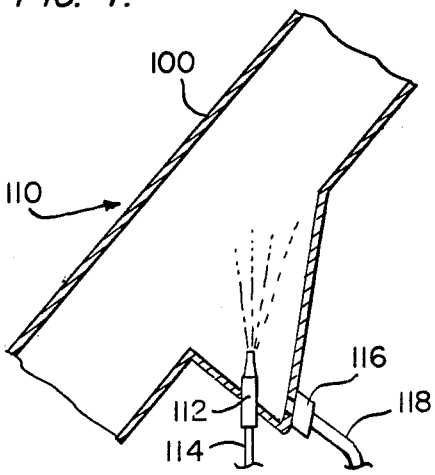
FIG. 4 is an enlarged sectional view, the means by which the moisture content of the dried tobacco may be increased if desired.

FIG. 4 is a detailed sectional view of spray manifold means 110 used to introduce moisture, if desired, back into the tobacco. Such means include a spray head 112 attached to duct 110 so as to spray water onto the tobacco material and gas stream as it passes through duct 100. A tube 114 is provided to supply water to the spray head and drain 116 and drain piping 118 are so located on manifold 110 so as to remove any excess water that is not absorbed by the tobacco but which accumulates at the bottom of the manifold.

While the invention has been described in connection with a preferred embodiment, it is not intended to limit the invention to the particular form set forth, but, on the contrary, it is intended to cover such alternatives, modifications, and equivalents as may be included within the spirit and scope of the invention as defined by the appended claims.

What is claimed is:

1. Apparatus for increasing the filling capacity of cut tobacco material comprising first means for elevating the temperature of the tobacco to about above 130° F. and moisture content of the tobacco such that the heating and moisturizing are performed for a time sufficient to permit cut tobacco to open from its compressed condition, means for forming a relatively thin dispersion of the opened tobacco in a gas, and means operatively connected to said first means for rapidly lowering the moisture content of the thin dispersion of tobacco as the tobacco is maintained in the thin dispersion in a generally laminar gas flow to about its making moisture within about five seconds such that the tobacco has achieved an expanded and opened condition which resists the closing back thereof.

2. An apparatus as set forth in claim 1 in which said first means elevates the moisture content to about between 15 to 35%.

3. An apparatus as set forth in claim 1 in which said first means elevates the temperature of the tobacco from about above 130° F. to about below the temperature at which the tobacco becomes charred or discolored.

4. An apparatus as set forth in claim 1 in which said elevating means uses a hot relatively dry gas to rapidly reduce the moisture content of the tobacco.

5. An apparatus as set forth in claim 4 in which said hot gas is heated to about between 300° F. to 600° F.

6. An apparatus as set forth in claim 4 in which said hot gas reduces the moisture content of the tobacco in about less than about two seconds.

7. An apparatus as set forth in claim 4 in which said hot gas has a water vapor pressure value which is significantly below the water vapor pressure within the conditioned tobacco.

8. Apparatus for increasing the filling capacity of a total blend of cut tobacco comprising conditioning means for at least elevating the temperature of the cut tobacco to about above 130° F. and below about the temperature at which the tobacco will be charred or discolored, and for elevating the moisture content of the tobacco to between about 15 to 35%, such that said heating and moisturizing are performed for a time sufficient to permit the cut tobacco to open from its compressed condition, means for forming the heated and moisturized tobacco into a relatively thin dispersion in a gas, and expanding means for rapidly reducing the moisture content of the tobacco to about its making moisture in a relatively dry hot gas medium which intimately contacts the surfaces of said thin dispersion of tobacco as the tobacco is maintained in the thin dispersion in a generally laminar gas flow, said hot gas medium having a temperature of from about 300° F. to 600° F. and serves to reduce the moisture content of the tobacco within about five seconds such that the filling capacity of the tobacco has increased and the closing back of the opening is resisted.

9. An apparatus as set forth in claim 8 in which said hot gas medium has a water vapor pressure significantly below the water vapor pressure within the tobacco.

10. An apparatus as set forth in claim 8 in which said conditioning means elevates the temperature of the tobacco to about 190° F.

11. An apparatus as set forth in claim 8 in which said expanding means conveys said stream of tobacco in a generally laminar gas flow therethrough in about less than about two seconds.

12. Apparatus for increasing the filling capacity of a total blend of cut tobacco comprising treating means for treating the cut tobacco by elevating the temperature of the cut tobacco to above about 130° F. and below about the temperature at which the tobacco will be charred or discolored, and for elevating the moisture content of the tobacco to between about 15 to 35% such that said heating and moisturizing are performed for a time sufficient to permit cut tobacco to open from its compressed condition; conveying means operatively connected to said treating means and including a first mechanism which delivers cut tobacco to said treating means and a second mechanism which conveys the treated open tobacco discharged from said treating means in successions of relatively thin layers of treated tobacco, means for forming the heated and moisturized tobacco into a relatively thin dispersion in a gas, and expanding means including drying means operatively connected to said forming means for receiving the thin dispersions of tobacco and for enabling rapid reduction in the moisture content of the tobacco by conveying the thin dispersions of tobacco therethrough with a relatively dry hot gas medium which intimately contacts the surfaces of the tobacco within a period of about 5 seconds as the tobacco is maintained in the thin dispersion in a generally laminar gas flow, said hot gas medium being heated to about between 300° F. and 600° F. and having a water vapor pressure value which is lower than the water vapor pressure within the treated tobacco, said expanding means also including means for increasing the velocity of said hot gas relative to the tobacco dispersed therein as said hot gas and said tobacco exit from said drying means such that the tobacco opens and expands to the extent that its filling capacity is increased.

13. An apparatus as set forth in claim 12 in which said expanding means includes separating means for separating said hot gas from said expanded and opened tobacco.

14. An apparatus as set forth in claim 13 in which said separatimg means includes air lock means for successively dispensing separated tobacco to a conveyor or the like.

15. An apparatus as set forth in claim 12 in which said treating means elevates the temperature of the tobacco to about 190° F.

16. An apparatus as set forth in claim 12 in which said drying means conveys said thin dispersion of tobacco and said hot gas in a generally laminar flow to adjacent an exit of said dryer means in about less than about 2 seconds.

17. An apparatus as set forth in claim 12 in which said velocity increasing means is comprised of a venturi member positioned in an outlet duct for said drying means.

18. Apparatus for increasing the filling capacity of a total blend of cut tobacco comprising in combination, a first conveying means, a heating, ordering, and metering chute connected adjacent an end of said first conveying means for receiving the discharged cut tobacco and for elevating the temperature of the tobacco from about above 130° F. to below about the temperature at which the tobacco will be charred or discolored and the moisture content of the tobacco to between about 15 to 35%, such that said heating and moisturizing are performed for a time period which is sufficient to permit cut tobacco to open from its compressed condition, a second conveying means adjustably connected to and adjacent a discharge end of said heating, ordering, and metering chute for receiving the treated tobacco and conveying successions of thin layers of tobacco from said ordering chute, drying means being connected to said second conveying means for receiving the layer of tobacco from said second conveying means and forming it into a thin dispersion in a gas, said drying means conveying said dispersion of tobacco therethrough within about less than 5 seconds with a relatively dry hot gas heated to about between 300° F. to 600° F. as the tobacco is maintained in the thin dispersion in a generally laminar gas flow, said hot gas having a water vapor pressure level which is substantially below the water vapor pressure of the water within the treated tobacco, a venturi member positioned within an outlet for said drying means for increasing the velocity of the hot gas with respect to the thin dispersion of tobacco such that said drying means and venturi member increases the filling capacity of the tobacco, and separating means connected to said drying means for separating the tobacco from said hot gas such that the tobacco can be subsequently discharged.

19. An apparatus as set forth in claim 18 including means to introduce moisture into the tobacco and gas after it has been dried and before it has been separated from said hot gas, thereby permitting variations as well as interruptions in flow rate of tobacco.

20. Apparatus for increasing the filling capacity of cut tobacco material comprising first means for elevating the temperature of the tobacco to about above 130° F. and about below the temperature at which the tobacco becomes charred or discolored and moisture content of the tobacco such that the heating and moisturizing are performed for a time sufficient to permit cut tobacco to open from its compressed condition, means for forming a relatively thin dispersion of the opened tobacco in a gas, and means operatively connected to said first means for rapidly lowering the moisture content of the thin dispersion of tobacco as the tobacco is maintained in the thin dispersion in a generally laminar gas flow to about its making moisture within about five seconds such that the tobacco has achieved an expanded and opened condition which resists the closing back thereof, said lowering means conveying a hot, relatively dry gas to reduce the moisture content of the tobacco and an expanding means for increasing the relative velocity of the air to the tobacco to wipe moisture from the tobacco surface.

* * * * *